US005501166A

United States Patent [19]

Ziober

[11] Patent Number: 5,501,166

[45] **Date of Patent: *Mar. 26, 1996**

[54] PERSONAL WATER CRAFT MOORING APPARATUS

[76] Inventor: James R. Ziober, 6N006 Riverside Dr., St. Charles, Ill. 60174

[ * ] Notice: The term of this patent shall not extend beyond the expiration date of Pat. No. 5,425,322.

[21] Appl. No.: 370,850

[22] Filed: Jan. 10, 1995

Related U.S. Application Data

[63] Continuation-in-part of Ser. No. 288,730, Aug. 15, 1994, Pat. No. 5,425,322.

[51] Int. Cl.[6] ..... B63B 21/00

[52] U.S. Cl. ..... 114/230; 114/44; 405/1

[58] Field of Search ..... 114/44, 49, 50, 114/344, 230; 405/1, 3, 7; 280/414.1; 248/129

[56] References Cited

U.S. PATENT DOCUMENTS

| | | | |
|---|---|---|---|
| 2,754,017 | 7/1956 | Hart et al. | 405/1 |
| 3,227,292 | 1/1966 | Jacobs | 405/1 |
| 5,005,846 | 4/1991 | Taylor | 114/344 |
| 5,016,893 | 5/1991 | Hart, Jr. | 248/129 |
| 5,163,378 | 11/1992 | Raymond | 114/44 |
| 5,184,913 | 2/1993 | Meriwether | 405/3 |
| 5,249,545 | 10/1993 | Gettman | 114/259 |

*Primary Examiner*—Jesus D. Sotelo

*Attorney, Agent, or Firm*—Kajane McManus

[57] ABSTRACT

The improved persons water craft mooring apparatus comprises a base upon which a cradle is pivotably mounted. To assure that the cradle may at all times be capable of a horizontal position, the base includes at least one pair of legs which are adjustable in length to accommodate for the contour of the underlying offshore surface.

3 Claims, 2 Drawing Sheets

FIG. 2
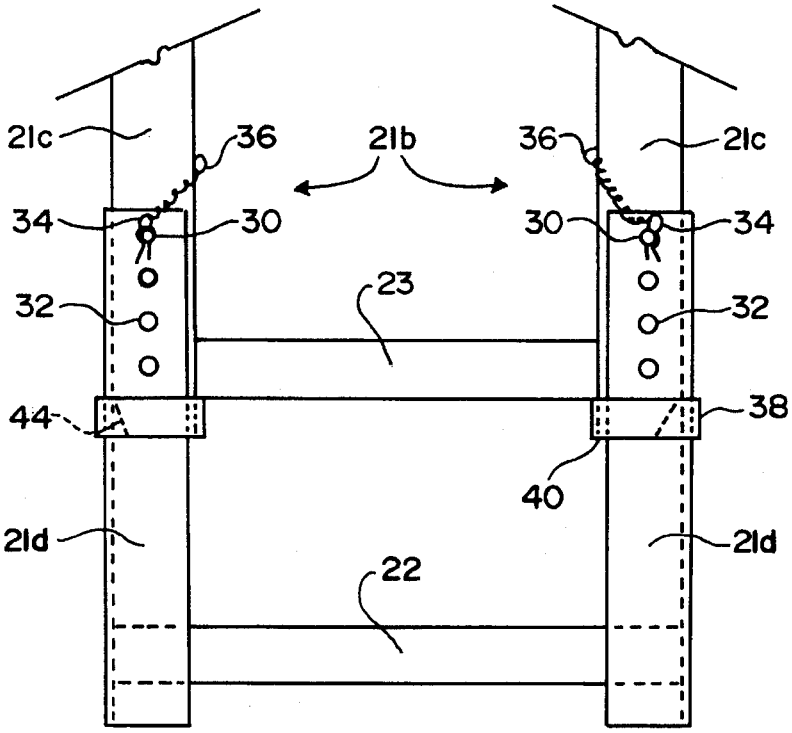
FIG. 3
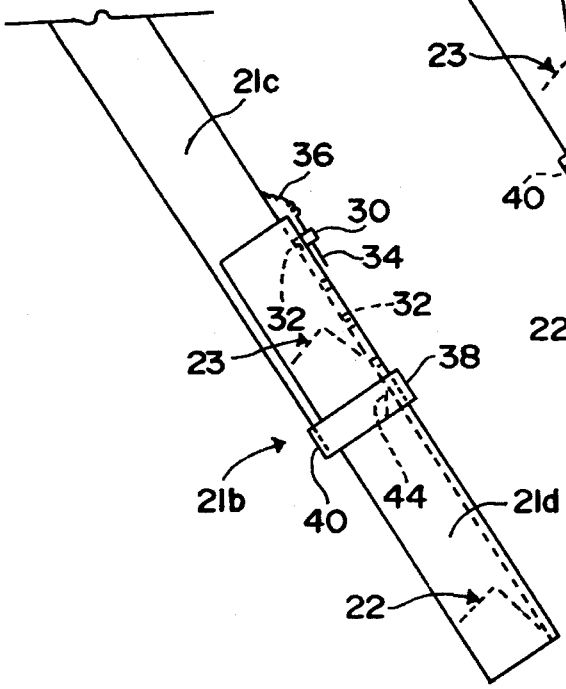
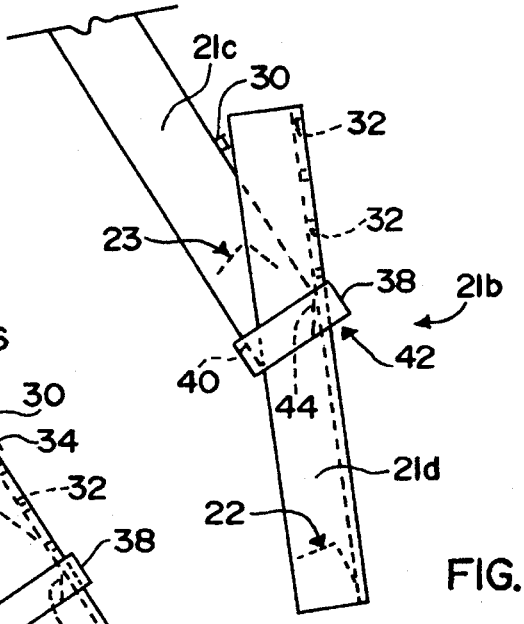
FIG. 4

PERSONAL WATER CRAFT MOORING APPARATUS

CROSS REFERENCE TO RELATED APPLICATIONS

This application is a continuation in part of U.S. application Ser. No. 08/288,730 filed Aug. 15, 1994, now U.S. Pat. No. 5,425,322 issued on Jun. 20, 1995, and entitled Portable Folding Personal Water Craft Mooring Standoff Apparatus.

BACKGROUND OF THE INVENTION

1. Field of the Invention

The present invention relates to an improved mooring apparatus for a personal water craft. More specifically the improvement comprises the provision of adjustable legs on the apparatus so that a cradle thereof upon which the water craft rests may be brought to a completely horizontal position regardless of the contour of the underlying off shore surface.

2. Prior Art

Heretofore, a personal water craft mooring apparatus of the type disclosed herein has been proposed in U.S. application Ser. No. 08/288,730, the teachings of which are incorporated herein by reference.

It has been found that when the contour of the offshore beach upon which the mooring apparatus is to be supported is too steep or is too convoluted, a problem may be incurred in positioning of the apparatus so that the cradle thereof may reach a horizontal position. Often, the apparatus must be moved to a better surface, or the surface must be dug into to accommodate secure placement of the legs for appropriate cradle positioning.

As will be described in greater detail hereinafter, the apparatus has been improved by adding adjustability of leg length to accommodate any underlying surface configuration.

SUMMARY OF THE INVENTION

According to the invention there is provided a portable personal water craft off shore mooring apparatus comprising a base and a pivotable cradle mounted thereon, the cradle pivoting in response to weight of the water craft as the water craft is propelled onto and off of the cradle, the cradle lifting the craft above a water line at the shore when the craft is moored on the apparatus.

BRIEF DESCRIPTION OF THE DRAWINGS

FIG. 2 is an enlarged front view of one pair of adjustable legs of the apparatus.

FIG. 3 is a front view showing sections of one leg joined together.

FIG. 4 is a side view showing sections of one leg being moved relative to one another.

DESCRIPTION OF THE PREFERRED EMBODIMENT

Figure 1:
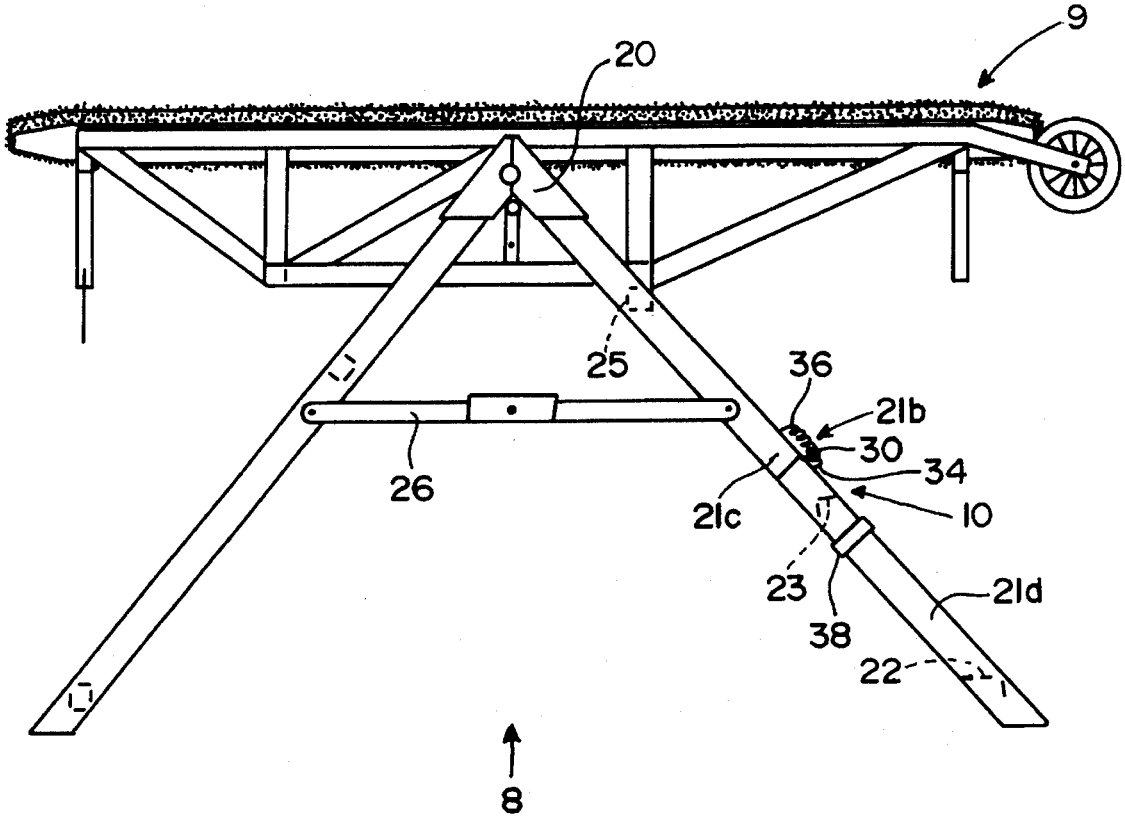
FIG. 1 is a side view of the mooring apparatus of the present invention.

Referring now to the drawings in greater detail, there is illustrated therein the personal water craft mooring apparatus of the present invention referred to generally by reference numeral 8.

As shown the apparatus 8 comprises two main components, a cradle 9 and a base 10.

The cradle 9 mounts to the base 10 in a manner to be pivotable relative to the base 10.

In this respect, it will be seen that the base 10 comprises a pair of spaced apart hinged legs 21 which are engaged to one another by means of a plurality of cross braces 22, 23, 24 and 25. Since the legs 21 are hinged and configured into an inverted V, the spread of each hinged leg 21 is restricted by the provision of a folding brace 26 extending between sections 21*a* and 21*b* of the leg 21 beneath a hinge 20, the hinge 20 being centered along the length of the leg 21, with the hinge 20 being covered by a cap (not shown).

The cross braces 24 and 25 are positioned in such a manner as to have a dual purpose. The braces 24 and 25 not only maintain the legs 21 in parallel, spaced apart relation, but act as stop members 24 and 25 for limiting rearward and forward tilt, respectively, of the cradle 9 when the cradle 9 is engaged to the base 10, as will be described in greater detail hereinafter.

Also, the two bottom cross braces 22 serve a secondary function. In this respect, when the apparatus 8 is set onto a soft underwater surface, the legs 21 will sink into the soft material, with the braces 22 acting as stabilizers for the apparatus 10 when the braces 22 sink into the soft surface.

As described above, contour of the supporting surface for the apparatus 8 has been found to create problems with regard to horizontal positioning of the cradle 9.

Thus, the improvement of adjustability in the height of one pair of leg sections 21*b* has come to be proposed hereinbelow.

Turning now to FIGS. 2–4, it will be seen that leg sections 21*b* are now broken down into two portions, 21*c* and 21*d*.

The portions 21*c* are engaged to one another by cross braces 23 and 25 while the portions 21*d* are engaged to one another by cross brace 22.

In the embodiment of the legs 21*b* disclosed herein, the legs 21*b* are formed of metal configured as angle iron, as are the cross braces 22 and 23. The leg sections 21*b* are formed of this cross sectional configuration so that leg portions 21*c* and 21*d* can slide relative to one another, providing adjustability in height of the pair of leg sections 21*b*.

As shown, leg portion 21*c* has a nub 30 thereon over which one of a linear plurality of slots 32 on leg portion 21*d* may engage.

It will be understood that the nub 30 is positioned identically on each leg portion 21*c* and that the slots 32 are positioned identically on each leg portion 21*d*.

As further shown, once the leg portions 21*c* and 21*d* are positioned relative to one another as desired, a fixing member 34, such as a cotter pin 34 may be engaged through or to the nub 30 in known manner to hold the leg portions 21*c* and 21*d* together.

For the sake of convenience, the fixing member 34 may be secured to the leg portion 21*c* by a chain 36 or the like so it is easily accessible and kept from being lost.

The leg portion 21*c* includes a bracket 38 on lower end edge 40 which is spaced from the surface of the leg portion 21*c* to create a channel 42 within which leg portion 21*d* can slide. The bracket 38 serves to maintain leg portion 21*d* contiguous to leg portion 21*c* when they are engaged together.

It will be understood the leg portion 21*d* must be capable of pivoting slightly away from leg portion 21*c* so that the slots 32 can be disengaged from the upstanding nubs 30.

With the chosen bracket 38 positioning, a corner 44 of leg 21*c* underlying the bracket 38 is chamfered to allow for pivotability of the leg portion 21*d*.

As described above, the improved apparatus 8 of the present invention provides a number of advantages, some of which have been described above and others of which are inherent in the invention. Also, modifications may be proposed to the improved apparatus 8 without departing from the teachings herein. Accordingly, the scope of the invention is only to be limited as necessitated by the accompanying claims.

I claim:

1. An improved portable personal water craft off shore mooring apparatus comprising a base consisting of two legs configured into an inverted V, with the legs being parallel and spaced apart, spacing between the legs being maintained by a plurality of cross members extending therebetween;

said cradle comprising a framework sized and configured to mount pivotably to the base, between the legs, the framework being centered upon the base, and;

said framework having two pads mounted thereon, the pads being parallel and spaced apart with a slight angulation toward one another to receive a bottom surface of a water craft thereon and therebetween, the improvement comprising the provision of legs which are adjustable in length at least at one end thereof, each comprising two converging sections which create an inverted V shaped leg, wherein two parallel leg sections each comprise at least two portions, the two leg portions being movable relative to each other to lengthen or shorten the leg section, as desired, and wherein one leg portion has a nub thereon and wherein a coacting leg portion has a linear array of slots therein, each of which engages over the nub, as desired length is set.

2. The apparatus of claim 1 wherein said leg portion having the nub thereon also includes a bracket at a free end thereof which creates a channel between itself and the free end within which the leg portion having the slots can slide.

3. The apparatus of claim 2 the leg portions are each L shaped in cross section, similar to angle iron, and wherein a corner of the leg portion behind the bracket is chamfered.

* * * * *